US005203306A

United States Patent [19]

Billingsley et al.

[11] Patent Number: 5,203,306

[45] Date of Patent: Apr. 20, 1993

[54] FUEL FEED SYSTEM

[75] Inventors: Henry C. Billingsley, Kenosha, Wis.; David J. Hartke; Glenn R. Belec, both of Gurnee, Ill.

[73] Assignee: Outboard Marine Corporation, Waukegan, Ill.

[21] Appl. No.: 830,769

[22] Filed: Feb. 3, 1992

Related U.S. Application Data

[63] Continuation of Ser. No. 489,279, Mar. 2, 1990, abandoned.

[51] Int. Cl.[5] ..... F02M 33/02

[52] U.S. Cl. ..... 123/518; 123/516

[58] Field of Search ..... 123/514, 516, 518, 519, 123/520, 521, 73 A, 73 AD; 417/395

[56] References Cited

U.S. PATENT DOCUMENTS

| | | | |
|---|---|---|---|
| 1,119,980 | 12/1914 | Mulligan | 55/170 |
| 1,381,897 | 6/1921 | Ackley | 123/518 |
| 1,804,557 | 5/1931 | Gould et al. | 55/170 |
| 1,851,163 | 3/1932 | Daugherty | 55/189 |
| 2,742,049 | 4/1956 | Granberg | 137/202 |
| 2,745,551 | 5/1956 | Berck | 183/2.5 |
| 2,811,219 | 10/1957 | Wenzl | 183/2.5 |
| 2,878,889 | 3/1959 | Gilbert | 183/2.5 |
| 2,917,110 | 12/1959 | Brohl | 158/36 |
| 2,998,057 | 8/1961 | Graham | 158/36.3 |
| 3,307,331 | 3/1967 | Lambert | 55/55 |
| 3,683,878 | 8/1972 | Rogers | 123/518 |
| 3,692,433 | 9/1972 | Finger | 417/395 |
| 3,703,165 | 11/1972 | Hansen | 123/136 |
| 3,709,202 | 1/1973 | Brown | 123/518 |
| 3,867,071 | 2/1975 | Hartley | 417/211.5 |
| 3,924,975 | 12/1975 | Hundertmark | 417/395 |
| 3,955,901 | 5/1976 | Hamilton | 417/395 |
| 3,961,918 | 6/1976 | Johnson | 55/170 |
| 3,985,626 | 10/1976 | Klein | 202/202 |
| 4,010,012 | 3/1977 | Griffin, III et al. | 55/169 |
| 4,070,828 | 1/1978 | Barres | 123/521 |
| 4,117,817 | 10/1978 | Nishida | 123/136 |
| 4,279,232 | 7/1981 | Schuster | 123/516 |
| 4,315,760 | 2/1982 | bij de Leij | 55/189 |
| 4,450,820 | 5/1984 | Haynes | 123/514 |
| 4,534,774 | 8/1985 | LeCoffrey et al. | 55/44 |
| 4,660,516 | 4/1987 | Beltz | 123/73 A |
| 4,829,968 | 5/1989 | Onafer | 123/518 |
| 4,844,043 | 7/1989 | Keller | 123/516 |
| 4,876,993 | 10/1989 | Slattery | 123/73 AD |
| 5,021,071 | 6/1991 | Reddy | 123/518 |
| 5,024,188 | 6/1991 | Hartke et al. | 123/195 |

FOREIGN PATENT DOCUMENTS

| | | | |
|---|---|---|---|
| 3035535A1 | 4/1982 | Fed. Rep. of Germany . | |
| 0021524 | 2/1977 | Japan | 123/519 |
| 0044334 | 4/1977 | Japan | 123/521 |
| 1410374 | 10/1975 | United Kingdom . | |

*Primary Examiner*—E. Rollins Cross
*Assistant Examiner*—Erick Solis
*Attorney, Agent, or Firm*—Michael, Best & Friedrich

[57] ABSTRACT

The invention provides a fuel feed system for an internal combustion engine, the system including a fuel pump, a vapor separator including a fuel chamber having an inlet and an outlet and being adapted to contain a supply of fuel, the vapor separator including a float valve and a passage for venting fuel vapor from the chamber when the supply of fuel is below a predetermined level, and a vapor pump communicating with the passage and a source of cyclically varying pressure for pumping fuel vapor from the vapor separator and to a location remote from said source of alternating pressure, the fuel vapor pump operating independently of the fuel pump.

13 Claims, 2 Drawing Sheets

FUEL FEED SYSTEM

This is a continuation of U.S. application Ser. No. 07/489,279 filed on Mar. 2, 1990, now abandoned.

Related Application

Attention is directed to U.S. application Ser. No. 316,153, filed Feb. 27, 1989, now abandoned, and entitled "Internal Combustion Engine", and U.S. application Ser. No. 07/487,669, filed Mar. 2, 1990 and entitled "Fuel Supply System Component Assembly", now U.S. Pat. No. 5,024,188.

BACKGROUND OF THE INVENTION

1. Field of the Invention

The invention relates generally to fuel feed systems for internal combustion engines and more particularly to fuel feed systems including vapor separators.

2. Reference to the Prior Art

In the prior art, it is generally known to provide a fuel feed system for an internal combustion engine including a fuel source and a fuel pump for pumping fuel from the source to the internal combustion engine. Because fuel for internal combustion engines is aromatic, fuel vapor easily evaporates from the fuel. When fuel in a fuel feed system is under relatively low pressure, excessive amounts of fuel vapor can form in the fuel feed system prior to introduction of the fuel to the internal combustion engine. In order to separate accumulated fuel vapor from the fuel supply prior to introduction of the fuel to the internal combustion engine, it is generally known to place a fuel vapor separator downstream of the fuel pump and before the introduction of fuel to the internal combustion engine.

Prior art designs for fuel vapor separators often introduce difficulty because the fuel vapor separator relies on negative pressure pulses from the engine to remove fuel vapor from the supply of fuel. In some applications, the engine is too small to provide adequate negative pressure pulses to remove the fuel vapor from the fuel supply.

Attention is directed to the fuel vapor separators disclosed in the following U.S. Patents:

| | | |
|---|---|---|
| 4,534,774 | LeCoffre et al. | August 13, 1985 |
| 4,450,820 | Haynes | May 29, 1984 |
| 4,315,760 | bij de Leij | February 16, 1982 |
| 4,117,817 | Nishida | October 3, 1978 |
| 4,010,012 | Griffin, III et al | March 1, 1977 |
| 3,985,626 | Klein | October 12, 1976 |
| 3,961,918 | Johnson | June 8, 1976 |
| 3,867,071 | Hartley | February 18, 1975 |
| 3,703,165 | Hansen | November 21, 1972 |
| 3,307,331 | Lambert | March 7, 1967 |
| 2,998,057 | Graham | August 29, 1961 |
| 2,917,110 | Brohl | December 15, 1959 |
| 2,878,889 | Gilbert | March 24, 1959 |
| 2,811,219 | Wenzl | October 29, 1957 |
| 2,745,551 | Berck | May 15, 1956 |
| 2,742,049 | Granberg | April 17, 1956 |
| 1,851,163 | Daugherty | March 29, 1932 |
| 1,804,557 | Gould et al. | May 12, 1931 |
| 1,381,897 | Ackley | June 21, 1921 |
| 1,119,980 | Mulligan | December 8, 1914 |

SUMMARY OF THE INVENTION

The invention provides a fuel feed system for an internal combustion engine, the system including a vapor separator including a fuel chamber having an inlet and an outlet and being adapted to contain a supply of fuel, the vapor separator including means for venting fuel vapor from the chamber when the supply of fuel is below a predetermined level, and a vapor pump communicable with the means for venting fuel vapor and a source of cyclically varying pressure, the vapor pump including means for pumping fuel vapor from the vapor separator and to a location remote from said source of alternating pressure.

In one embodiment of the invention the source of cyclically varying pressure is a source of alternating positive and negative pressure, and the vapor pump includes means for pumping fuel vapor from the fuel chamber when the source supplies negative pressure and for pumping fuel vapor when the source supplies positive pressure.

The invention also provides a fuel feed system for an internal combustion engine, the fuel feed system including a vapor separator having a fuel reservoir and a cover sealingly engaged with the fuel reservoir to form, with the reservoir, a fuel chamber adapted for containing a supply of fuel, the vapor separator including means for venting fuel vapor from the fuel chamber when the supply of fuel in the fuel chamber is below a predetermined level, and a vapor pump for pumping fuel vapor from the vapor separator, the vapor pump being located on the cover and communicable with the means for venting fuel vapor.

The invention also provides a fuel feed system for an internal combustion engine, the system including a fuel pump, and a vapor separator assembly including a fuel chamber adapted for containing a supply of fuel and having an inlet and an outlet, the assembly including means for venting fuel vapor from the fuel chamber when the supply of fuel is below a predetermined level and for pumping fuel from a fuel source to the assembly independently of the fuel pump.

The invention also provides fuel feed system for an internal combustion engine, the system including a fuel pump communicating with the engine, and a vapor separator located between a fuel source and the fuel pump, the vapor separator including a fuel chamber adapted to contain a supply of fuel, and means for venting fuel vapor from the chamber when the supply of fuel in the chamber is below a predetermined level.

Other features and advantages of the invention will become known by reference to the following description, and claims, and the appended drawings.

Figure 2:
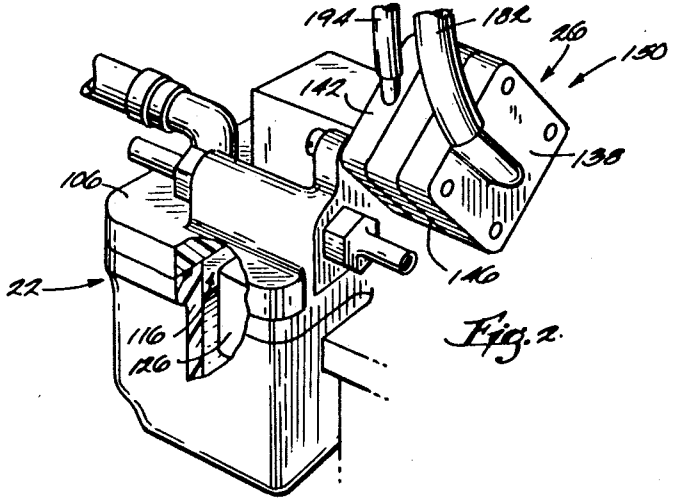
FIG. 2 is an enlarged rear perspective view, partially in section, of a portion of the fuel feed system shown in FIG. 1.
Figure 5:
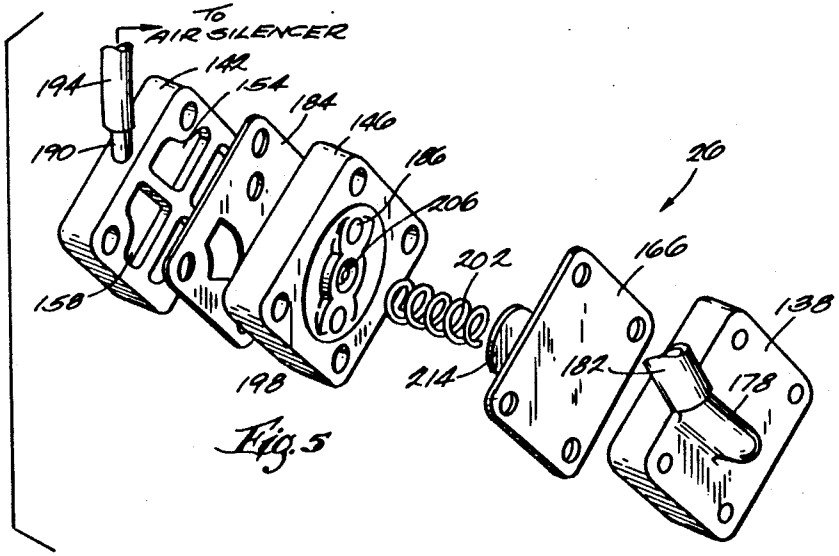
FIG. 5 is an enlarged, exploded view, of a portion of the fuel feed system shown in FIG. 2.

Before one embodiment of the invention is explained in detail, it is to be understood that the invention is not limited in its application to the details of the construction and the arrangements of components set forth in the following description or illustrated in the drawings.

The invention is capable of other embodiments and of being practiced or being carried out in various ways. Also, it is to be understood that the phraseology and terminology used herein is for the purpose of description and should not be regarded as limiting.

DETAILED DESCRIPTION

Figure 1:
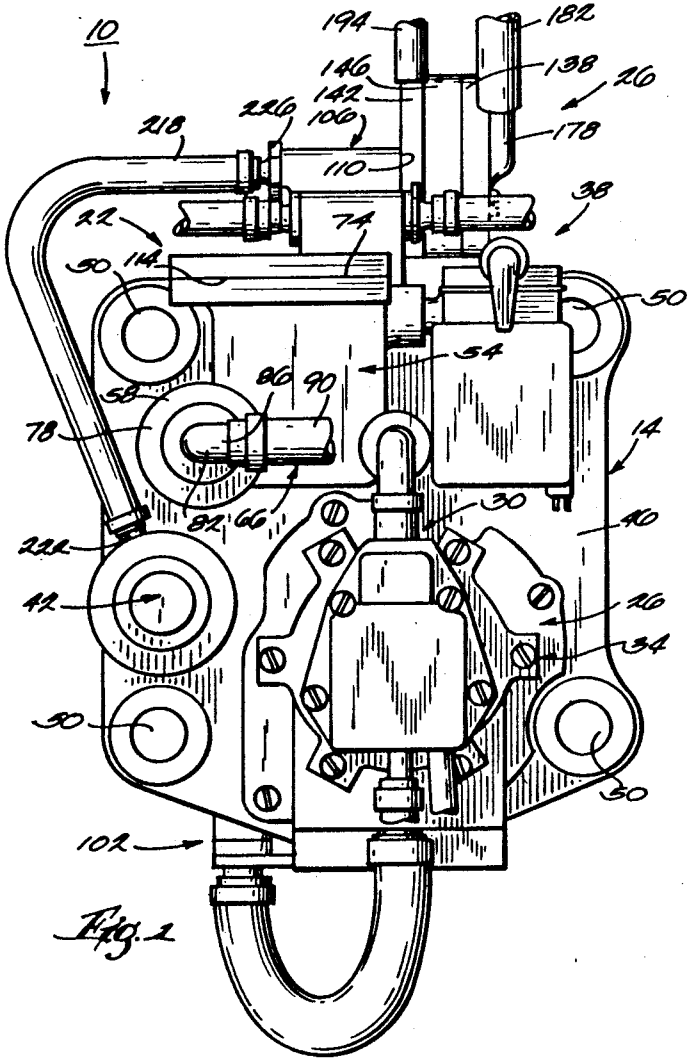
FIG. 1 is an elevation view of a fuel feed system for an internal combustion engine embodying various of the features of the invention.

Shown in FIG. 1 is a fuel supply system 10 for an internal combustion engine. The fuel supply system 10 is adapted to supply fuel to at least one carburetor (not shown) and includes a mounting bracket 14 which supports the following fuel system components: a fuel vapor separator 22, a fuel vapor pump 26, a fuel pump 30, an oil pump 34 (which fuel and oil pumps can be combined into a combined fuel and oil mixture pump), a primer fuel control valve 38, and a vacuum switch 42.

While other constructions can be employed, the mounting bracket 14 is formed of rigid plastic and includes at least one conduit and portions of the fuel vapor separator 22. More particularly, the mounting bracket 14 includes a generally flat base portion 46 which includes four mounting holes 50 and a reservoir 54 which is part of the fuel separator 22. The reservoir 54 extends forwardly and rearwardly from the base portion 46 and is located at the top of the mounting bracket 14. The reservoir 54 includes a first cylindrical portion 58 which extends forwardly from the base portion 46 and is open at the front end 62, and a second box-like portion 66 which communicates with the cylindrical portion 58 through an opening 68. The box-like portion 66 has an open top 70 which is defined by a generally rectangular and flat mounting surface 74.

The open end 62 of the cylindrical portion 58 is closed by a removable cover or cap 78 which includes an inlet 82 terminating in the form of a nipple 86 connected to an exterior fuel supply hose 90 adapted to communicate with a suitable source of fuel. A fuel filter 94 is located within the cylindrical portion 58 of the reservoir 54.

The mounting bracket 14 also integrally includes an interior fuel supply conduit or bore 98 which communicates with the reservoir 54 and which extends therefrom interiorly of the bracket to the bottom of the mounting bracket and terminates in a discharge end or fitting 102. Any suitable arrangement can be employed interiorly of the mounting bracket 14 to provide the fuel supply conduit or passage 98.

The fuel supply system component assembly 10 also includes means for positively pumping fuel vapor from the fuel vapor separator 22. While other constructions could be employed in the disclosed embodiment, the means for positively pumping fuel vapor includes the before mentioned fuel vapor pump 26 and means for mounting the fuel vapor pump 26 on the fuel vapor separator 22. While other constructions could be employed, in the disclosed embodiment the fuel vapor pump 26 is removably mounted on a reservoir cover member or part 106. The reservoir cover 106 is fabricated of plastic and includes on one side, a flat fuel vapor pump mounting surface 110, and on another side a flat surface 114 which mates with the flat mounting surface 74 on the top of the reservoir 54. The fuel vapor pump 26 is removably mounted on the mounting surface 110 of the cover member 106 by any suitable means, such as screws. When the reservoir cover 106 is removably connected or assembled on the bracket 14 by any suitable fasteners, as for instance screws, the cover 106 sealingly closes the open top 70 of the box-like reservoir portion 66 to complete the fuel reservoir 54 and define a fuel chamber 116 adapted to contain a supply of fuel, as well as any fuel vapor which might emanate from the fuel.

Figure 3:
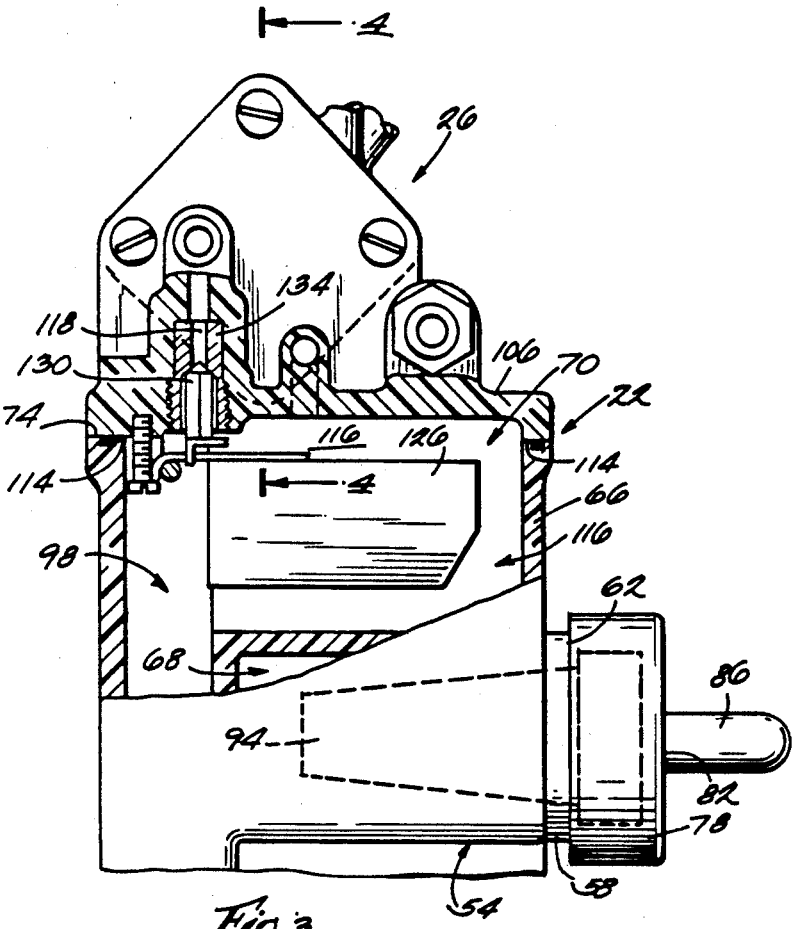
FIG. 3 is an enlarged side view, partially in section, of a portion of the fuel feed system shown in FIG. 1.
Figure 4:
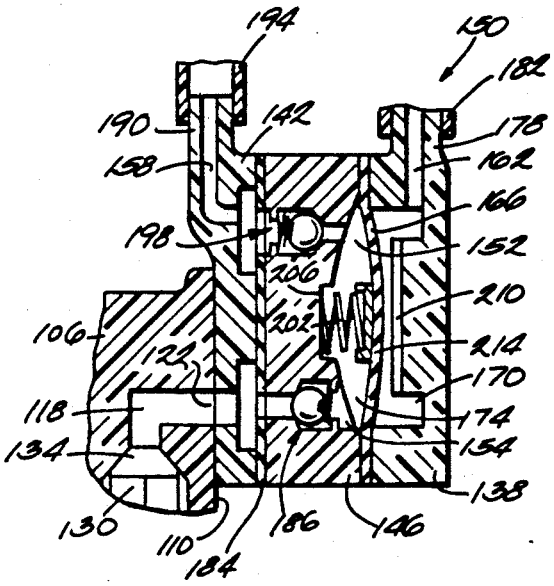
FIG. 4 is a sectional view taken along line 4—4 in FIG. 3.

The fuel supply system also includes means for venting fuel vapor from the fuel chamber 54 when the supply of fuel in the chamber 54 is below a predetermined level, including, in the cover member 106 (see FIG. 3), a fuel vapor passage or vent 118 which, at one end, communicates with the fuel chamber 116 and which, at the other end (see FIG. 4), terminates in a port 122 in the fuel vapor pump mounting surface 110.

The means for venting fuel vapor also includes means for affording communication between the fuel chamber 54 and the fuel vapor vent 118 when the supply of fuel in the fuel chamber 116 is below a predetermined level. While other arrangements could be used, in the disclosed embodiment, the means for affording communication between the fuel vapor vent 118 and the fuel chamber 116 includes a float 126 which is hingedly supported by the cover member 106 inside the fuel chamber 116 and which is responsive to the level of the supply of fuel in the fuel chamber 116. In response to the level of fuel in the fuel chamber, the float 126 moves a valve member 130 relative to a valve seat 134 located in the fuel vapor vent 118 to control fuel vapor flow from the fuel separator 22. In this last regard, when the fuel in the reservoir drops below a predetermined level, operation of the float 126 permits the valve member 130 to move away from the valve seat 134 to an open position, thereby opening the fuel vapor vent 118. When the fuel in the reservoir rises to the predetermined level, the float 126 moves the valve member 130 into engagement with the valve seat 134 thereby preventing passage of fuel vapor into the vent 118.

While other constructions could be employed, the fuel vapor pump 26 is provided consequent to assembly of three disk-like members 138, 142, 146 which, in turn, are assembled to the cover member by suitable fasteners. The disk-like members are also assembled together by suitable fasteners, such as screws. When assembled, the three disk-like members, a first end disk 138, a second end disk 142, and a middle disk 146 therebetween, form a shell 150 having therein a chamber 152, a fuel vapor inlet 154, a fuel vapor outlet 158, and a pressure port 162.

The middle disk 146 and the first end disk 138 define the chamber 152 therebetween. A diaphragm 166 placed between the middle disk 146 and the first end disk 138 divides the chamber 152 into a driving chamber 170 adjacent the first end disk 138, and a driven chamber 174. In the preferred embodiment, the diaphragm 166 is made of rubber or some other flexible, gas impermeable material.

The fuel vapor pump 26 includes means for alternating the pressure in the driving chamber 170. While other arrangements could be employed, the means for alternating pressure in the driving chamber includes the pressure port 162 which communicates with the driving chamber 170 and extends through the first end disk 138 and terminates in the form of a nipple 178 which is connected to any suitable exterior hose or conduit 182 which, in turn, is adapted to be connected to a suitable source of varying cycling or pulsating pressure. In the disclosed construction, it is contemplated that the exterior hose 182 will be connected to an engine crankcase.

The fuel vapor inlet 154 communicates at one end with the driven chamber 174 and extends through the middle disk 146, the second end disk 142, and a gasket 184 located between the middle disk 146 and the second end disk 142, and at another end mates with the fuel vapor passage port 122 in the mounting surface 110 of the cover member 106. The vapor pump 26 provides means for affording communication between the fuel vapor vent 118 and the driven chamber 174 in the form of a one-way valve 186 located in the fuel vapor inlet 154. The one-way valve 186 affords communication between the fuel vapor vent 118, and the driven chamber 174 when the pressure in the fuel vapor vent 118 is greater than the pressure in the driven chamber 174 and prevents communication between the fuel vapor vent 118 and the driven chamber 174 when the pressure in the driven chamber 174 is greater than the pressure in the fuel vapor vent 118.

The fuel vapor outlet 158 communicates at one end with the driven chamber 174 and extends through the middle disk 146, the gasket 184, and the second end disk 142 and terminates at another end in the form of a nipple 190 for receiving an exterior conduit 194 in the form of a hose or tube adapted for conveying fuel vapor to a suitable point in the engine remote from the source of alternating pressure, as for instance to an air silencer (not shown).

The vapor pump also provides means for affording communication between the fuel vapor outlet 158 and the driven chamber 174 in the form of a second one-way valve 198. The second one-way valve 198 affords communication between the fuel vapor outlet 158 and the driven chamber 174 when the pressure in the driven chamber 174 is greater than the pressure in the fuel vapor outlet 158 and prevents communication between the fuel vapor outlet 158 and the driven chamber 174 when the pressure in the driven chamber 174 is less than the pressure in the fuel vapor outlet 158.

The fuel vapor pump also includes means for biasing the diaphragm 166 in one direction. In the illustrated embodiment, a spring 202 is provided to bias the diaphragm 166 away from the middle disk 146 and toward the first end disk 138. The middle disk 146 is provided with a seat 206 for the spring 202. The first end disk 138 includes a metal pad 210 for contacting the diaphragm 166. The means for biasing the diaphragm 166 also includes a circular plastic member 214 on the end of the spring 202 adjacent the diaphragm 166 for protecting the diaphragm 166 from tearing by the spring 202.

Operation of the vapor separator assembly is as follows. During periods of extended inactivity, fuel can drain from the reservoir 54 in the fuel vapor separator 22 back to a source of fuel. Upon initiation of operation of the internal combustion engine, alternating positive and negative pressure from the crankcase initiates operation of the fuel pump 30 and is introduced to the driving chamber 170 in the fuel vapor pump 26.

As explained below, the fuel pump 30 and the fuel vapor pump 26 independently draw fuel from the fuel source into the reservoir 54 through the fuel filter 94. While the supply of fuel in the reservoir increases, but remains below a predetermined level, the valve member 130 remains in an open position to allow the fuel vapor pump 26 to draw fuel vapor and air from the reservoir 54. The fuel vapor pump 26 removes fuel vapor from the reservoir through the fuel vapor vent 118, and consequently draws fuel from the fuel source into the reservoir 54.

During operation of the internal combustion engine, both positive and negative pressure pulses act on the driving chamber 170 to deflect the diaphragm 166. When a negative pulse acts on the driving chamber 170 through the pressure port 162, the negative pressure pulse, and the spring 202 acting on the diaphragm 166, deflect the diaphragm 166 to enlarge the driven chamber 174, and thereby create relatively low pressure in the driven chamber 174. Because of the relatively low pressure in the driven chamber 174, the one-way valve 186 located between the driven chamber 174 and the fuel vapor passage port 122 opens to allow air or fuel vapor to be drawn through the vapor vent 118 into the driven chamber 174 and the second one-way valve 198 located between the driven chamber 174 and the outlet 158 remains closed to prevent the passage of fuel vapor.

When the engine provides a pulse of positive pressure, the driving chamber 170 expands and acts upon the diaphragm 166 and the spring 202 to make the driven chamber 174 smaller. As the pressure in the driven chamber 174 increases because of its diminishing size, the one-way valve 186 between the vapor passage port 122 and the driven chamber 174 closes to prevent the passage of fuel vapor. During the positive pressure pulse, relatively high pressure in the driven chamber 174 causes the second one-way valve 198 between the driven chamber 174 and the fuel vapor outlet port 158 to open, allowing discharge of fuel vapor from the driven chamber 174, through the fuel vapor outlet port 158, and into the conduit 194 leading to the air silencer.

As the level of the fuel in the reservoir 54 increases to a predetermined level, the float 126 rises in response to the increasing level of fuel and moves the valve member 130 into engagement with the valve seat 134, preventing passage of fuel vapor from the reservoir 54 through the fuel vent 118 and into the vapor pump 26.

During normal operation of the internal combustion engine, the flow of fuel from the inlet 82 through the reservoir 54 and into the conduit 98 continues because of operation of the fuel vapor separator 22. As the pressure of fuel vapor in the reservoir 54 grows, or upon demand of fuel by the internal combustion engine greater than the capacity of the fuel pump 30, the level of fuel in the reservoir 54 will drop. The float 126 will drop in response to the decreasing level of fuel and will move the valve member 130 to an open position to allow passage of fuel vapor through the vent 118 and into the vapor inlet 154 of the fuel vapor pump. The fuel vapor pump 26 removes fuel vapor from the reservoir 54, consequently complementing operation of the fuel pump 30 by drawing fuel into the reservoir 54 until the level of fuel in the reservoir 54 increases to a predetermined level and the float 126 moves the valve member 130 into engagement with the valve seat 134.

Thus fuel vapor is removed from the fuel vapor separator 22 by drawing fuel vapor into the driven chamber 174 during negative pressure pulses from the engine and by expelling fuel vapor from the driven chamber 174 during positive pressure pulses from the engine. Provision of the fuel vapor pump 26 in combination with the vapor separator 22 allows removal of fuel vapor from the fuel vapor separator 22 with a minimum pressure head, and allows use of a vapor separator with smaller engines.

Further, during start up of the engine, the vapor pump 26 draws air and fuel vapor from the reservoir 54 independently of operation of the fuel pump 30, increasing the level of fuel in the reservoir more rapidly than operation of a fuel pump and a vapor separator without a vapor pump. Also, because both the fuel pump 30 and the fuel vapor pump 26 draw fuel from a fuel source, a smaller fuel pump may be used. The vapor separator can be placed between the fuel pump and the fuel source because a smaller fuel pump does not introduce zones of low pressure which result in excessive fuel vapor.

Various of the features of the invention are set forth in the following claims.

We claim:

1. A fuel feed system for an internal combustion engine, said system comprising a vapor separator including a fuel chamber having an inlet and an outlet and being adapted to contain a supply of fuel, said vapor separator including means for venting fuel vapor from said chamber when said supply of fuel is below a predetermined level, a fuel pump communicating with said vapor separator for supplying fuel to the internal combustion engine, and a vapor pump which is independent of said fuel pump and which is communicable with said means for venting fuel vapor and a source of cyclically varying pressure, said vapor pump including means for pumping fuel vapor from said vapor separator and to a location remote from the source of alternating pressure.

2. A fuel feed system as set forth in claim 1 wherein the source of cyclically varying pressure is a source of alternating positive and negative pressure, and wherein said vapor pump includes means for pumping fuel vapor from said fuel chamber when said source supplies negative pressure and for pumping fuel vapor when said source supplies positive pressure.

3. A fuel feed system as set forth in claim 2 wherein said means for venting fuel vapor includes a vapor vent communicating with said fuel chamber and means for affording communication between said fuel chamber and said vapor vent when said supply of fuel in said fuel chamber is below a predetermined level, said means for affording communication between said fuel chamber and said vapor vent including a valve member engageable with a valve seat located in said vapor vent, and a float responsive to the level of the supply of fuel in the fuel chamber for moving said valve member into engagement with said valve seat and for moving said valve member away from said valve seat to an open position.

4. A fuel feed system as set forth in claim 2 wherein said vapor pump includes an outer wall defining a shell, a diaphragm dividing the shell into a driving chamber and a driven chamber, an inlet communicable with said driven chamber and said means for venting fuel vapor, an outlet communicable with said driven chamber, means in said inlet for affording communication between said means for venting fuel vapor and said driven chamber when the pressure in said means for venting fuel vapor is greater than the pressure in said driven chamber and for preventing communication between said means for venting fuel vapor and said driven chamber when the pressure in said means for venting fuel vapor is less than the pressure in said driven chamber, and means for allowing communication between said outlet and said driven chamber when the pressure in said driven chamber is greater than the pressure in said outlet and for preventing communication between said outlet and said driven chamber when the pressure in said driven chamber is less than the pressure in said outlet, and means for alternating the pressure in said driving chamber.

5. A fuel feed system as set forth in claim 4 wherein said means for alternating the pressure in said driving chamber includes a conduit communicating between the source of alternating pressure and said driving chamber.

6. A fuel feed system as set forth in claim 5 wherein said vapor pump is located on said vapor separator.

7. A fuel feed system for an internal combustion engine, said fuel feed system comprising a vapor separator having a fuel reservoir and a cover sealingly engaged with said fuel reservoir to form, with said reservoir, a fuel chamber adapted for containing a supply of fuel, said vapor separator including means for venting fuel vapor from said fuel chamber when said supply of fuel in said fuel chamber is below a predetermined level, and a vapor pump for pumping fuel vapor from said vapor separator, said vapor pump being located on said cover and communicable with said means for venting fuel vapor.

8. A fuel feed system for an internal combustion engine, said system comprising a fuel pump, and a vapor separator assembly including a fuel chamber adapted for containing a supply of fuel and having an inlet adapted to be connected to a fuel source and an outlet adapted to be connected to a carburetor, said assembly including means for venting fuel vapor from said fuel chamber when said supply of fuel is below a predetermined level, and said means for venting fuel vapor from said fuel chamber including a vapor pump which also serves to pump fuel from the fuel source to said assembly independently of said fuel pump.

9. A fuel feed system as set forth in claim 8 wherein said vapor separator assembly includes a vapor separator having a vapor vent communicable with said fuel chamber and with said vapor pump, and means for affording communication between said vapor vent and said fuel chamber when said supply of fuel in said fuel chamber is below a predetermined level.

10. A fuel feed system as set forth in claim 9 wherein said vapor pump includes an inlet communicable with said vapor vent, and an outlet, and communicates with a source of varying cycling pressure.

11. A fuel feed system as set forth in claim 10 wherein said source of varying cycling pressure is a source of alternating positive and negative pressure.

12. A fuel feed system as set forth in claim 11 wherein said vapor pump includes means for pumping fuel vapor from said vapor pump when said pressure source supplies positive pressure and for pumping fuel vapor from said chamber when said pressure source supplies negative pressure.

13. A fuel feed system for an internal combustion engine, the system comprising a fuel pump communicating with the engine, a vapor separator located between a fuel source and said fuel pump, said vapor separator including a fuel chamber adapted to contain a supply of fuel, and means for venting fuel vapor from said chamber when said supply of fuel in said chamber is below a predetermined level, and a vapor pump which is independent of said fuel pump and which communicates with said venting means and with the engine independently of the communication of said fuel pump with the engine.

* * * * *